United States Patent [19]

Anthony et al.

[11] Patent Number: 4,942,649

[45] Date of Patent: Jul. 24, 1990

[54] SAFETY BELT BUCKLE

[75] Inventors: James R. Anthony, Carmel; David Merrick, Indianapolis; Ronald F. Homeier, Plainfield; Allan R. Lortz, Carmel, all of Ind.

[73] Assignee: Indiana Mills & Manufacturing, Inc., Westfield, Ind.

[21] Appl. No.: 357,805

[22] Filed: May 30, 1989

Related U.S. Application Data

[63] Continuation-in-part of Ser. No. 160,405, Feb. 25, 1988, Pat. No. 4,876,772.

[51] Int. Cl.[5] ..... A44B 11/25

[52] U.S. Cl. ..... 24/637; 24/643

[58] Field of Search ..... 24/637, 639, 635, 640, 24/641, 638, 642, 643

[56] References Cited

U.S. PATENT DOCUMENTS

| | | | |
|---|---|---|---|
| 3,396,437 | 8/1968 | Burleigh . | |
| 3,440,697 | 4/1969 | Proctor . | |
| 4,121,327 | 10/1978 | Huntley . | |
| 4,127,922 | 12/1978 | Mita . | |
| 4,128,924 | 12/1978 | Happel et al. . | |
| 4,182,008 | 1/1980 | Pouget . | |
| 4,195,392 | 4/1980 | Ueda et al. . | |
| 4,197,619 | 4/1980 | Burleigh . | |
| 4,301,576 | 11/1981 | Cunningham . | |
| 4,313,246 | 2/1982 | Fohl . | |
| 4,358,879 | 11/1982 | Magyar | 24/641 |
| 4,368,563 | 1/1983 | Lentz | 24/637 |
| 4,382,320 | 5/1983 | Yamamura . | |
| 4,385,425 | 5/1983 | Tanaka et al. . | |
| 4,388,746 | 6/1983 | Krautz et al. . | |
| 4,393,557 | 7/1983 | Schmidt . | |
| 4,394,792 | 7/1983 | Schmidt | 24/637 |
| 4,403,376 | 9/1983 | Palloks . | |
| 4,425,688 | 1/1984 | Anthony et al. . | |
| 4,527,317 | 7/1985 | Straszewski et al. . | |
| 4,535,514 | 8/1985 | Grabowski | 24/637 |
| 4,562,625 | 1/1986 | Doty et al. | 24/643 |
| 4,577,378 | 3/1986 | Harenberg . | |
| 4,587,696 | 5/1986 | Ueda et al. . | |
| 4,611,369 | 9/1986 | Weir . | |
| 4,614,010 | 9/1986 | Charlton et al. | 24/639 |
| 4,617,705 | 10/1986 | Anthony et al. . | |
| 4,677,715 | 7/1987 | Escaravage . | |
| 4,677,716 | 7/1987 | Monsigny | 24/641 |
| 4,692,970 | 9/1987 | Anthony et al. . | |

FOREIGN PATENT DOCUMENTS

| | | | |
|---|---|---|---|
| 1589059 | 5/1981 | United Kingdom | 24/642 |

*Primary Examiner*—Victor N. Sakran

*Attorney, Agent, or Firm*—Woodard, Emhardt, Naughton, Moriarty & McNett

[57] ABSTRACT

A seat belt buckle has a plastic outer body of a color and style suitable for the intended environment, with a formed steel inner frame having horizontally-spaced upturned sides having two parallel pairs of in-turned flanges serving as crush inhibitors, release slide guides, and tongue receiver guides. An upturned frame front flange cooperates with the sides and flanges as a wrack resistor and tongue retainer. The body front has a trough-shaped entrance to admit a latchable tongue, one margin of the entrance being provided by the sloped front of an end-release operating slide. A removable slide front button is curved to assist finding for release. A pivoting latching member with a latching pawl thereon is spring-urged into position latching the pawl with the tongue, and released by a cam on the slide, with a shallow ramp for ease of intentional release. A tongue ejector holds the pawl in unlatched position when the tongue is out of the buckle. Ribs on sides of the release slide and on the latching member inhibit dirt fouling.

19 Claims, 6 Drawing Sheets

SAFETY BELT BUCKLE

BACKGROUND OF THE INVENTION

This is a continuation-in-part patent application of parent application Ser. No. 160,405, filed Feb. 25, 1988 U.S. Pat. No. 4,876,772.

FIELD OF THE INVENTION

This invention relates generally to safety belt buckles, and more particularly to a buckle having a release slide with end-operated release button.

DESCRIPTION OF THE PRIOR ART

Safety belt buckles are marketed in a great variety. In recent years, perhaps the largest volume of buckles has been used for seat belts in the transportation industry, a portion of that being in motor vehicles. Some of the problems associated with safety belt buckles include user difficulty installing the belt tongue in the buckle, inadvertent release by the user bumping the release button, premature release due to inertial effects or deformation during a collision, and crushing damage to a buckle which has fallen into a position where it is exposed to damage by closing a vehicle door on the buckle or forcing a foldable seat onto it. The present invention is the result of efforts addressed to overcoming these problems.

SUMMARY OF THE INVENTION

A buckle according to a typical embodiment of this invention includes a body, a cover and a frame inside the body and cover. The buckle frame has a base, parallel walls upstanding from the base and spaced to admit a latchable tongue therebetween, and two pairs of coplanar in-turned side flanges on the walls. A pivoting latch plate mounted to the walls above the base, has a latching pawl projecting upward thereon. One of the flange pairs cooperates with the frame walls and a front flange upturned from the base, to define an entrance for a latchable tongue. The latch plate being pivotable on the frame, enables the latching pawl to move upward into a latching position to interfere with movement of a belt tongue through the entrance. A spring urges the plate to move the pawl to the interfering position. The two pairs of flanges define a guideway for a manually-operable tongue release slide which has a pawl release cam ramp thereon, the slide having a rest position and a release position, and normally biased to the rest position. Sides of the latch plate and release slide have series of ribs thereon engageable with guide surfaces in the frame to minimize accumulations and detrimental effects of dirt on operation of these components.

The latch plate has a cam follower arm engageable by the cam ramp when the slide is moved from the rest position to the release position to move the latching pawl out of the latching position.

A stop on the cam follower arm, and a boss on the slide, are abuttingly engageable with each other when the buckle is latched, to prevent movement of the pawl out of the latching position when the tongue is latched, until intentionally released. The slide has a convex end face for manual operation to the release position, and a snap-on cap to color-match the cover.

DESCRIPTION OF THE PREFERRED EMBODIMENTS

Figure 1:
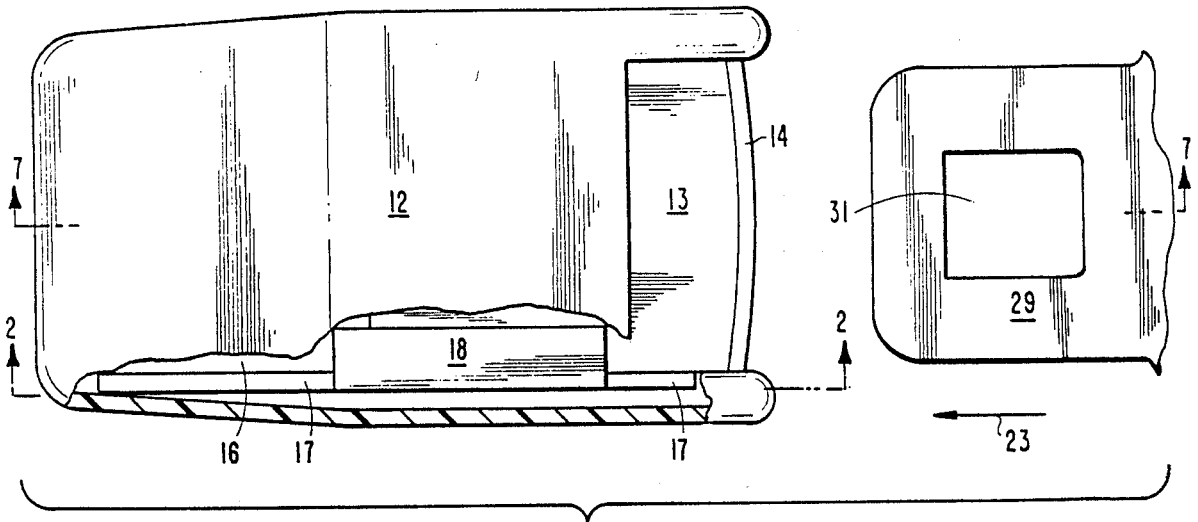
FIG. 1 is a top plan view of a safety belt buckle, with a belt latching tongue (shown fragmentally) positioned for insertion into the buckle, a portion of the buckle cover being broken out to show the buckle frame inside.

Referring now to the drawings in detail, particularly FIGS. 1–10, the exterior features of the buckle assembly include a body 11, cover 12, and release button slide 13 and button front 14. These are all typically made of plastic and may be of a color or colors selected for desired esthetic effect. A buckle frame made of stamped steel is mounted in the body and includes a base 16, parallel upstanding sidewalls 17, a first pair of co-planar inwardly-turned and facing flanges or ears 18, (FIGS. 1 and 10) and a second lower or intermediate pair of co-planar inwardly turned and facing flanges or ears 19. The frame has a front flange 21 turned up from the base at the front and having an upper edge 22 which defines the lower edge of an entrance for a belt tongue inserted in the direction of arrow 23.

Figure 7:
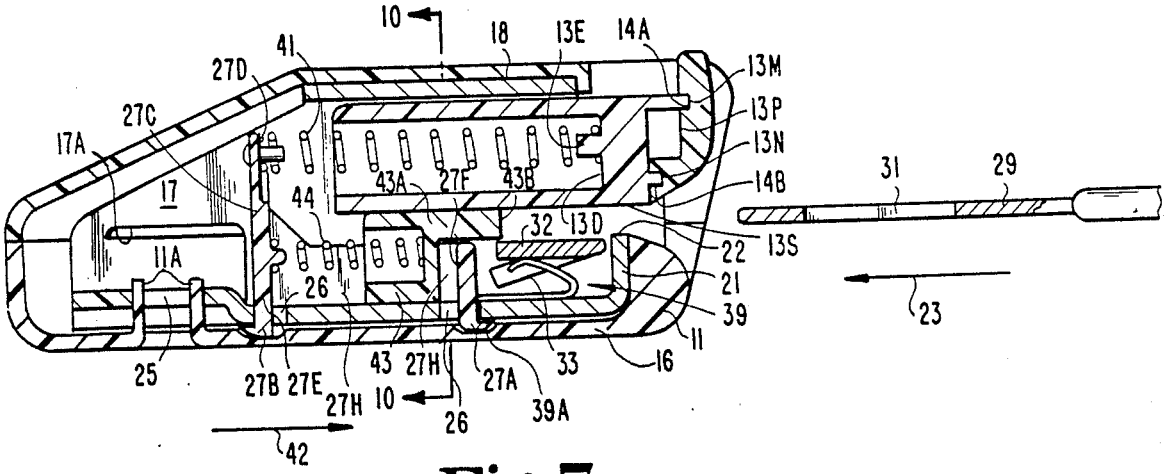
FIG. 7 is a longitudinal section through the buckle taken at line 7—7 in FIG. 1 and viewed in the direction of the arrows.

The frame sidewalls, which are essentially identical to each other, have pawl pivot apertures 24 therein. The base 16 has several centrally located rectangular apertures (FIG. 7). One of these is the belt connecting aperture 25. The other two are ejector holder mounting apertures 26 receiving the front and rear latching feet 27A and 27B of the ejector holder 27. Shallow recesses are provided in the top surface of the bottom of the buckle body to receive and provide clearance for the latching lugs at the feet of the ejector holder.

Figure 8:
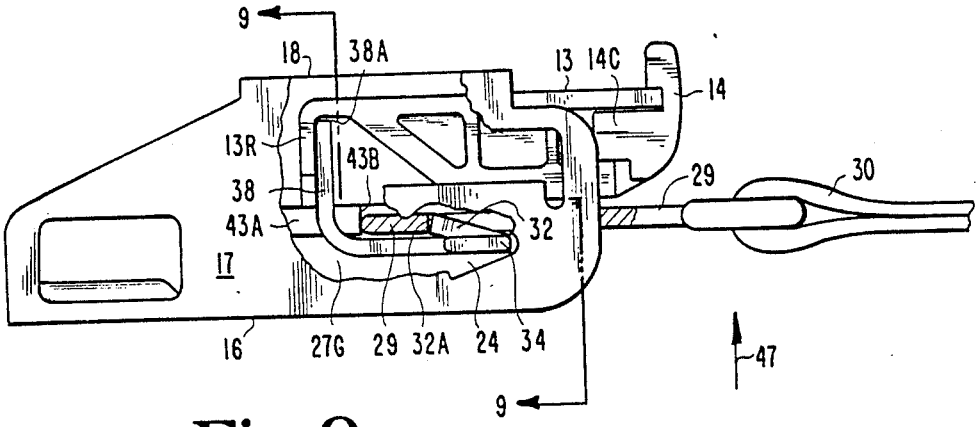
FIG. 8 is a view similar to FIG. 5 but showing the buckle in the latched condition.

A conventional belt latching tongue can be used with this buckle and typically includes a steel plate 29 having some non-abrasive cushion coating around the belt mounting portion, the latter having an aperture through the coating and plate to receive the belt 30 (FIG. 8) through it. A latching aperture 31 in the tongue plate receives a latching pawl 32 when the tongue is installed in the buckle as shown in FIG. 8. The pawl 32 is formed on the top front end of a latching plate 33. The latching plate has a pair of pivot posts 34 (FIG. 2), one at each side, and each of which is received in one of the pawl pivot apertures 24 in the frame walls 17. Because of the substantial length of these pivot posts in the direction from the front pivoting edge 36 thereof to the rear edge 37, all of which is integral with the latch plate itself 33 and directly adjacent the pawl 32, they are very strong and well able to withstand any tongue loading that can be expected to be applied to them while the buckle is in the latched condition. The latching plate 33 has an upturned rear arm 38 with a cam follower surface at its upper front edge 38A.

The latching plate, and thereby pawl 32, is biased in a clockwise direction by a leaf spring 39 (FIGS. 5 and 7) whose upper curved portion is received and directly engages the latching plate in a concavity directly under the pawl. The base of the spring rests on the base of the frame, and has end 39A which hooks around the front edge of the front hole 26 in the base, and is sandwiched and held in place by ejector holder latching foot 27A.

The pawl release slide 13 has flat, horizontally spaced, co-planar longitudinally extending bottom surfaces 13A and 13B (FIGS. 3, 5, 6 and 10) which are slidably received on top of the frame flanges 19. The normal forward rest position for this slide when the belt tongue is unlatched is shown in FIGS. 1–5 and 7 where it is urged forward by a release return coil spring 41 urging the slide forward in the direction of arrow 42. Forward movement in that direction is stopped by engagement of the front face of a boss 13C (FIGS. 4 and 5) of the slide with the upper rear edge 38B of the latch plate arm 38. The rear support for the release return spring 41 is provided by an upstanding post 27C integral with the rear end of ejector holder 27. The spring seats in pocket 27D, centered on a pin mounted to the post 27C at the center of the pocket. The front end of the spring is seated on wall 13D at the front of a rearward-opening spring housing cavity in the slide 13, and is centered on integral pin 13E (FIGS. 4 and 7) at the front wall.

Figure 10:
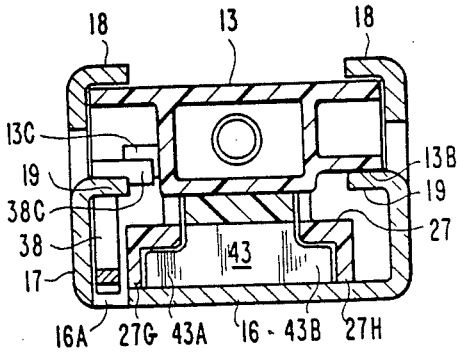
FIG. 10 is a cross section taken at line 10—10 in FIG. 7 and viewed in the direction of the arrows.
Figure 11:
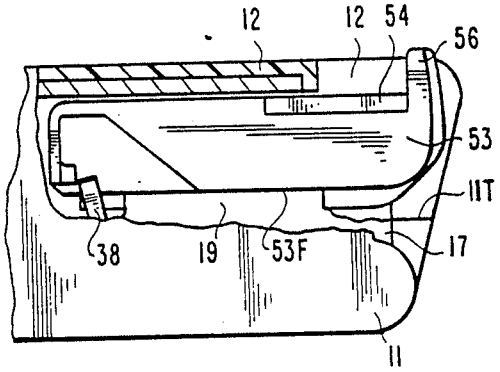
FIG. 11 is a fragmentary view similar to FIG. 5 but including also the body and cover as in FIG. 7, and showing a preferred embodiment of the buckle release slide and top cap.

The ejector holder 27 has the spring seat post 27C and rear latching foot 27B at the top and bottom, respectively, of a rear wall 27E. It has front latching foot 27A at the bottom of front wall 27F. The ejector holder is made of a durable, low-friction plastic, having some resilience so that the front and rear feet can be pressed toward each other sufficiently during assembly to enter the holes 26, and then released to snaP into secure engagement with the front and rear margins of the front and rear holes, respectively, with the hook portions of the feet retaining the feet on the base. The two longitudinally extending side walls 27G and 27H (FIGS. 4 and 10) of the ejector have inverted L-shapes providing a longitudinally extending groove which is of an inverted T-shape as best shown in FIG. 10 and which guidingly receives the ejector 43, which has laterally projecting lower side flanges 43A and 43B received in the groove of the ejector holder 27. The ejector is also made of a durable low-friction plastic and is biased forward by a coil spring 44 (FIG. 7) whose rear end is received around the projecting boss and seated on the rear wall 27E of the ejector holder. The spring 44 extends forward under spring 41 through the open space 46 (FIG. 4) between walls 27G and 27H of the ejector holder into the spring pocket in the rear of the ejector and seats on the front wall of the pocket. The ejector has a forwardly extending head 43A with a front end 43B which faces the approaching belt tongue.

Figure 3:
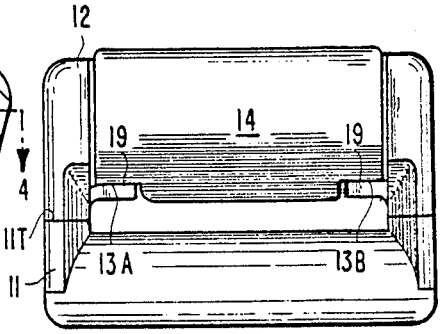
FIG. 3 is a front end view of the buckle.

To aid insertion of the belt tongue into the buckle entrance, guidance is available from the inclined faces of the release button front at the top of the entrance, the cover and body front at the sides of the entrance, and the body front at the bottom of the entrance, which inclined faces cooperate to form a sort of entrance trough (as indicated in FIGS. 3 and 7). Having passed the entrance guide trough, the tongue will continue to be guided by the inside faces of the side walls 17, the bottom face 13S of the release slide, and the upper edge 22 of front flange 21. The leading edge of the tongue will engage the front end 43B of the ejector and push it to the rear against the bias of the spring 44. As soon as the latching aperture 31 of the tongue passes the rear end 32A of the pawl, the pawl return spring 39 will force the pawl upward into latching position in the aperture 31. This condition is shown in FIG. 8. As arm 38 of latching member 33 rises, edge 38B moves up and off of the boss 13C permitting the release slide to move forward slightly under the urging of the spring 41. This forward return movement of the release slide is stopped by abutment of the downwardly extending rear flange 13R of the slide with the rear surface of the latch plate arm 38.

Figure 2:
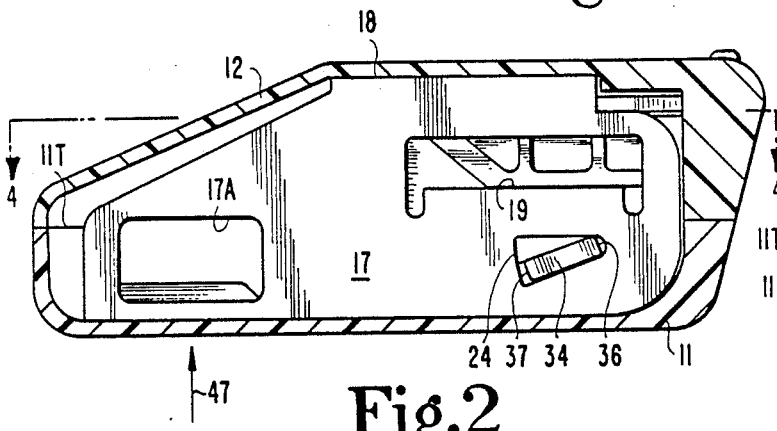
FIG. 2 is a longitudinal section taken at line 2—2 in FIG. 1 and viewed in the direction of the arrows, with the buckle in the open, unlatched condition.
Figure 9:
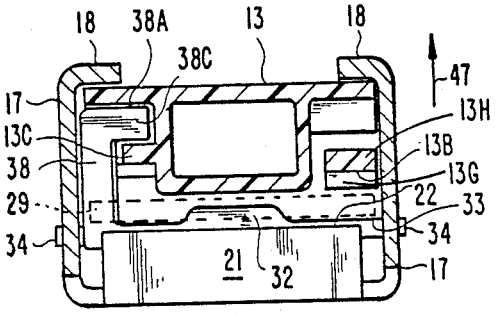
FIG. 9 is a cross section taken at line 9—9 in FIG. 8 and viewed in the direction of the arrows and showing the removable latching tongue in dotted lines.

To prevent inadvertent release of the pawl in response to large accelerations perpendicular to the buckle such as in the direction of the arrow 47 in FIG. 2, a pawl lock catch is provided by the boss 13C as it projects out from the release slide between the release cam surface 13F and the slide rear end flange 13R and, in fact, projects forwardly from the lower edge of flange 13R (FIG. 5) and laterally outward from the spring cavity wall of the slide (FIGS. 9 and 10). The latch plate arm 38 has an inwardly projecting wing 38C (FIGS. 4, 9 and 10) which projects inwardly over the top of the pawl lock catch when the release button is in the normal rest position with the buckle latched as shown in FIGS. 8 and 9. In the event of acceleration of the buckle frame in the direction of arrow 47 enough to overcome the latching force of the pawl return spring 39, the relative movement of the pawl opposite direction of arrow 47 is stopped by the abutting engagement of the bottom edge of wing 38C of the latch plate arm 38 with top of the pawl lock catch boss 13C.

In order to release the tongue, it is necessary to move the pawl down out of the aperture 31 in the tongue. For this purpose, the downwardly and rearwardly facing release cam surface 13F (FIGS. 3, 5 and 8) is provided on the slide and is engageable with the cam follower surface 38A as the slide is pushed to the rear in the direction of arrow 23 (FIG. 1). Pushing the slide to the rear causes the cam to drive the follower down, thus pivoting the latching plate 33 in a counterclockwise direction about the pivot edge 36 and against the urging of the spring 39. As the pivoting occurs, the pawl moves out of the aperture 31. When this occurs, the ejector slides forward (arrow 42 in FIG. 7) as forced to do so by the spring 44, pushing the tongue out of the buckle. It is sufficiently forceful to eject the tongue completely out, even though the ejector travel is limited by the front end wall 27F of the ejector holder. As the ejector pushes the tongue out, the front end 43B of the ejector head moves over the top of the depressed pawl as it is shown beginning to do in FIG. 7. Since the ejector's lateral flanges 43A and 43B remain confined by the ejector holder, the ejector does not move upward as it could otherwise do as a result of the return force of spring 39 urging of the latching plate upward at the pawl. Instead, the ejector head 43A holds the latching plate down. This condition persists until the tongue 29 is re-inserted to push the ejector back but, at that time, the tongue will maintain the latching pawl depressed until the latching aperture 31 has moved in far enough for the pawl to rise into latching position of FIGS. 8 and 9 again. The maintenance of the pawl in the depressed unlatching position makes it easy to insert the tongue and, consequently, reduces wear on the tongue and pawl.

The downward slope of the buckle entrance front surface of the body 11, which starts downward immediately in front of the frame front flange 21, minimizes the likelihood that a coin or other foreign object can become lodged in the buckle entrance. The upper rear end of the body front surface at the buckle entrance at front frame flange edge 22 (FIG. 7) is preferably less than 0.625 inches from the front end 43B of the ejector head when the ejector is in the rest position. Nevertheless, if it somehow happens that the ejector is pushed back (other than by the entering tongue) to the point where it will uncover the pawl, the pawl may rise and inhibit subsequent insertion of the tongue. This can be overcome by manually pushing the release button to the rear in the normal way to pivot the pawl down out of the way as the tongue is inserted.

The arrangement of the components, and particularly the slope of the cam 13F, distance of the cam follower edge from the pivot edge 36, location of the pawl edge 32A from the pivot edge, is such as to give a 4 to 1 mechanical advantage to the user pushing the end of the button 14 to release the buckle. Also it provides a half inch button travel from the latching rest position of FIG. 8 to a pawl release position shown dotted in FIG. 5. This is in a buckle whose overall dimensions are about 3.2 inches long, 1.2 inches high and 1.8 inches wide. This relatively significant button travel for release minimizes the chance of inadvertent release by the user. Use of the pivoting pawl and low-friction materials such as Teflon for the slide and ejector contribute to the ease of operation. The formed steel frame with the inwardly folded lower flanges 19 and upturned front flange 21 support the tongue during prying loads. The inwardly folded upper flanges 18 increase crush resistance and enhance protection of the internal components.

A further feature of the invention pertains to the button front. As shown in FIGS. 3 and 5–8, the lower portion of the button front 14 is sloped inward to provide the upper wall of the entrance "trough." In this embodiment, this button front is a cap distinct from the rest of the slide and has two slots 14A and 14B (FIG. 7) in a rear face thereof which receive mating features 13M and 13N respectively of the slide, 13M being the front edge of the top of the slide, and 13N being a rib on the front wall of the slide. Side-located catch tabs 14C project rearward from the button front, and have inwardly projecting catch shoulders 14D received in side opening cavities at the front of the slide, whereby the tabs are latched to the rear faces of the front walls 13L of the cavities. The material of the button front cap 14 can be a plastic identical in color and composition to that of the body 11 and cover 12. ABS material is an example. The tabs 14C are flexible enough to permit spreading them to install the front cap 14 on the slide, but resilient and stiff enough to remain firmly in place, once installed. This feature enables standardization of the internal components of the buckle, including the slide, but using outer materials for the body, cover and slide front cap as specified by the customer of the buckle manufacturer. The front of the cap 14 is convex curved or crowned as shown best in FIG. 1, which facilitates finding it by feel in the dark. The separability of the cap 14 from the slide, as just described, enables not only choice of color but also a different style front.

Figure 4:
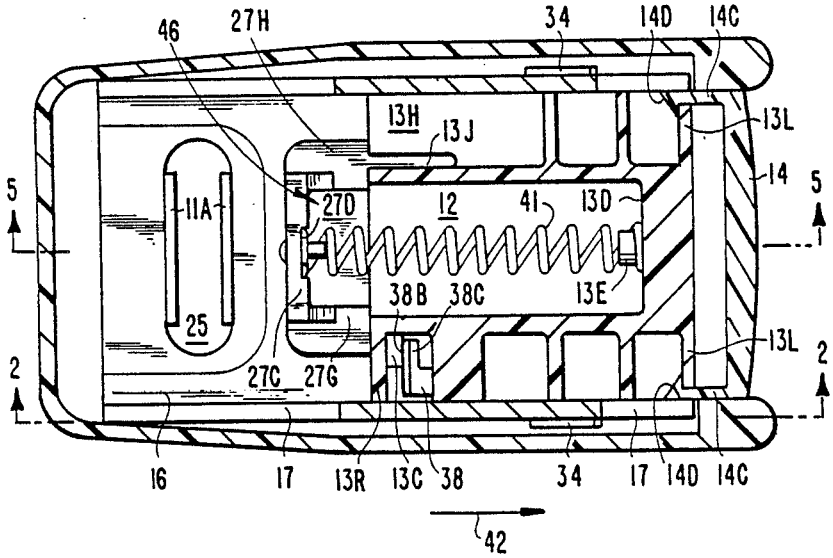
FIG. 4 is a section taken at line 4—4 in FIG. 2 and viewed in the direction of the arrows.

Another feature facilitating standardization is the provision of the apertures 17A in the side walls of the frame, and the rise with aperture 25 in the rear of the base as shown in FIGS. 4 and 7. The body 11 and cover 12 are joined by ultrasonic welding or other suitable means at the line 11T (FIGS. 2 and 3). In the illustrated embodiment, the body has a bottom rear opening with upwardly extending tabs 11A received in the aperture 25 of the frame base. This enables anchoring the buckle to a belt attachment fitting entering the bottom. Alternatively, if it is desired to use a fitting entering the side, a body with side openings in registry with the frame openings 17A, can be used.

Figure 5:
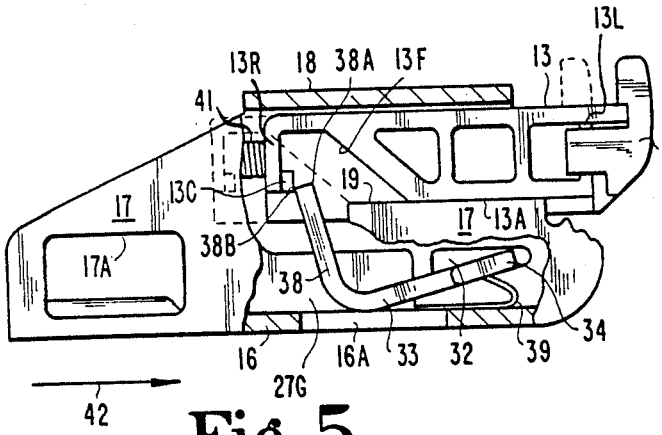
FIG. 5 is a side elevational view with the body and cover removed, and a portion of the frame side broken out to show interior details.
Figure 6:
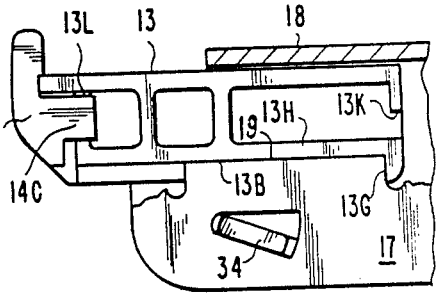
FIG. 6 is a fragmentary view of the side opposite that in FIG. 5, and showing the release slide return travel stop.

A slot 16A is provided in the base 16 to accommodate the lower end of arm 38 of the latch plate when it is pushed down to the position of FIG. 5 by operation of the release slide. Rearward travel of the slide will be stopped by engagement of the upper rear wall of the button front with the front edge 12A of the cover 12. If it somehow happens that, after the slide returns to the unlatch rest position of FIG. 5, the latching plate is bumped downward relative to the slide, and disengages the stop boss 13C, the slide return spring 41 will force the slide forward. It would exit completely from the buckle except for a stop shoulder 13G (FIGS. 6 and 9) at the bottom rear of the right hand side of the slide, and which will abuttingly engage the rear end of the flange 19. That shoulder is located at the rear end of the slide bearing extension arm 13H (FIGS. 4, 6 and 9). If it is desired to remove the slide from the frame while the buckle body and cover are off, this arm can be resiliently bent upward relative to the slide and the flange 19, since there is a slot 13J (FIG. 4) between this arm and the slide spring cavity wall, so the arm is cantilevered from the part of the slide directly in front of it, and is not attached at the side of the slide. When the rear end of the arm is bent upward, then the shoulder 13G will clear the rear end of the flange 19 and permit removal of the slide from the frame. Re-installation can be done by likewise bending the arm upward to clear the front edge of the flange 19.

Figure 12:
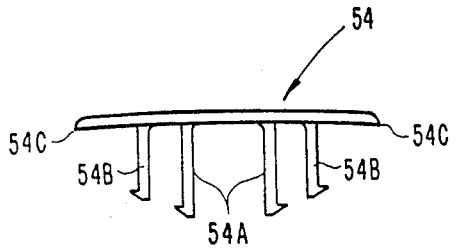
FIG. 12 is a rear elevational view of the release button top cap.
Figure 13:
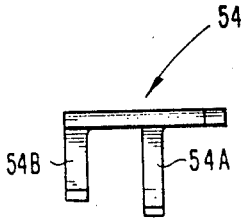
FIG. 13 is a side elevational view of the release button top cap.
Figure 14:
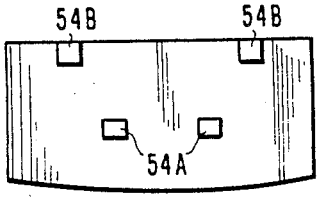
FIG. 14 is a bottom view of the release button top cap.
Figure 15:
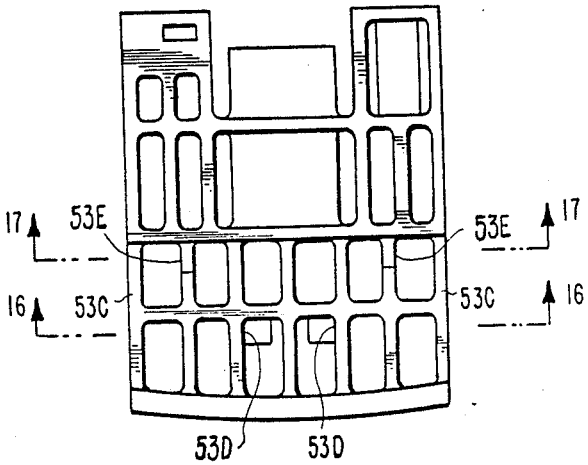
FIG. 15 is a top plan view of the release slide without the top cap.
Figure 16:
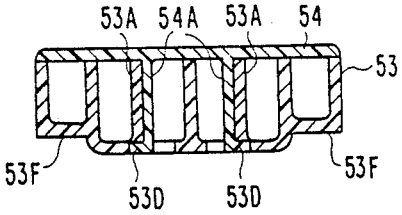
FIG. 16 is a section through the release slide assembly taken at the location of line 16—16 in FIG. 15 and viewed in the direction of the arrows and showing the cap latched in place.
Figure 17:
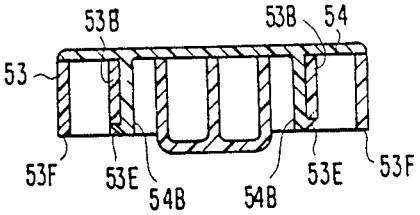
FIG. 17 is a section through the release slide assembly taken at line 17—17 in FIG. 15 and viewed in the direction of the arrows and showing the cap latched in place.
Figure 18:
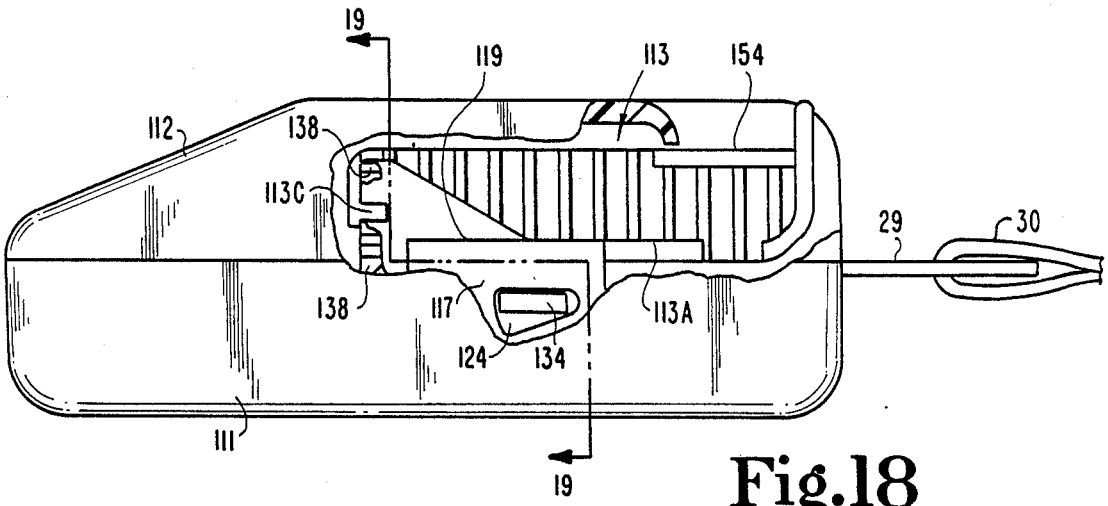
FIG. 18 is a side elevational view of an alternate embodiment of the buckle and wherein the release slide of this embodiment includes a removable top cap as is done in the embodiment of FIGS. 12 through 17, rather than the removable front end cap as in the embodiments of FIGS. 1 through 10, and with a portion of the body, cover and frame omitted to show side rib details of the latch member and release slide according to this embodiment.
Figure 19:
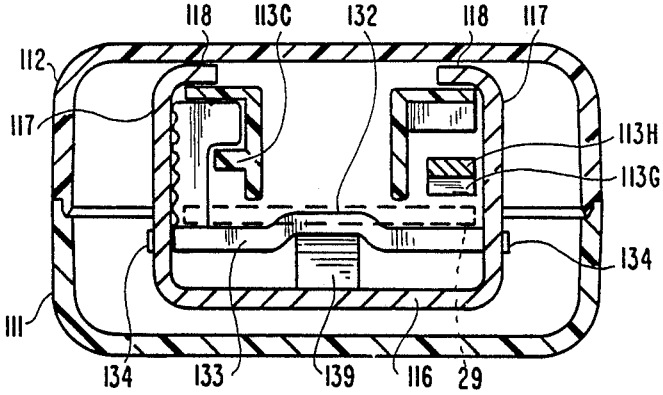
FIG. 19 is a cross section therethrough taken at line 19—19 in FIG. 18 and viewed in the direction of the arrows.
Figure 20:
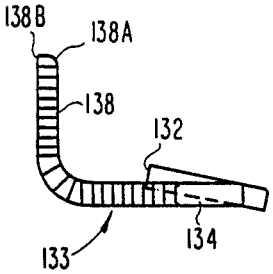
FIG. 20 is a side elevational view of the latch member itself.
Figure 21:
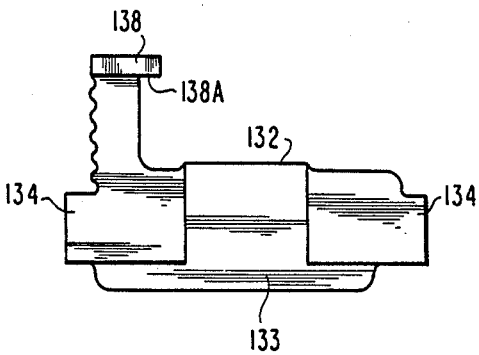
FIG. 21 is a top plan view of the latch member.
Figure 22:
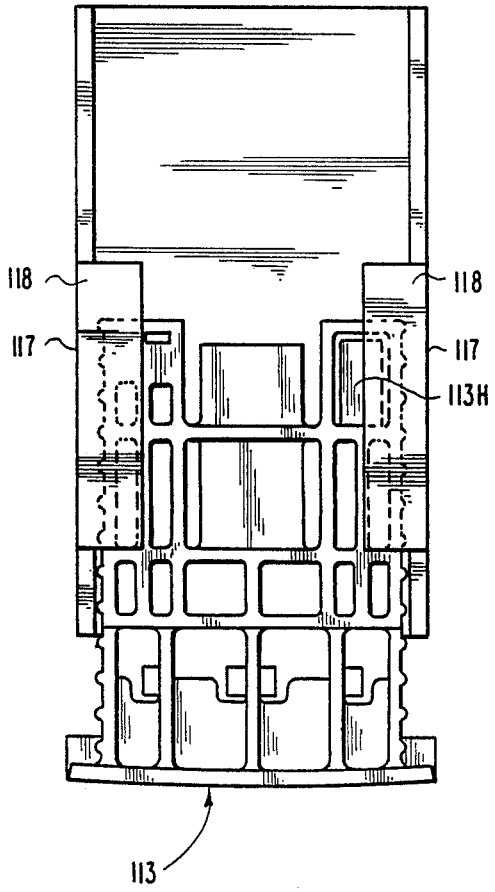
FIG. 22 is a top plan view of the release slide in the frame.
Figure 23:
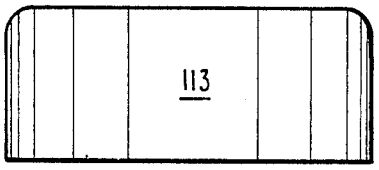
FIG. 23 is a front elevational view of the release slide.
Figure 24:
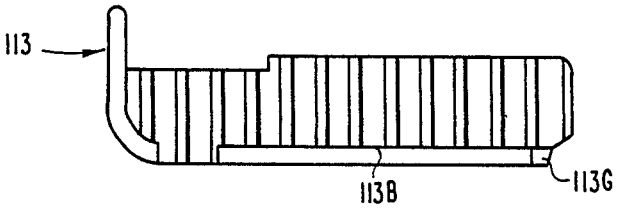
FIG. 24 is a side elevational view of the release slide.

Referring to FIGS. 11–17, a preferred embodiment of release slide is shown at 53. Instead of having the closed top and bottom with open side construction as in slide 13, the slide 53 is more open at the top and closed at the sides. This enables snap-on mounting of cap 54 on the top of the slide immediately behind the upstanding front flange 56 which, on the first-described embodiment, was part of the snap-on front end cap 14. To be specific, the cap 54 has two front legs 54A and two rear legs 54B. Each of these has an outwardly directed shoulder adjacent its lower end as best shown in FIG. 12. These shoulders slide downward along the vertical web walls 53A and 53B of the slide 53 as the cap is pushed down onto the slide, until the shoulders reach the lower edges of the webs, whereupon the legs resiliently snap outward, and the shoulders move out under the lower edges of the webs.

It can be seen in FIG. 12, that the cap has a slight crown. The lower outer edges first contact the outboard top surface 53C of the slide. As the cap is finally pushed flat into place, the leg shoulders snap out under the lower edges of walls 53A and 53B. When the cap installing force is released, the stress introduced in the cap as the crown was pushed flat, serves to pull upward on the legs 54A and 54B and thereby resiliently and tightly hold the latching shoulders against the bottom edges of the web walls 53A and 53B at 53D and 53E, respectively. The bottom surfaces 53F of the slide 53 are slidably received on the top of the frame flanges 19 as in the first-described embodiment. The slide 53 thus operates in all respects as described above with reference to slide 13. The advantage of this embodiment is that the slide can be a bright color such as red or orange in all frame assemblies in production quantities. But where various decorative colors are to be used for the body and cover, the top of the slide can be covered with a cap of matching color. The only portion displaying the bright color is the end which is to be pushed to release the tongue. For example, in the buckle assembly of FIG. 11, with the body and cover 12 colored blue, the cap 54 is a matching blue, but the slide 53 and its exposed front face is a bright red, making it easy for the user to see where to push to unlatch the tongue. The same standardized frame and slide, without cap, can be adapted to any desired color scheme by selecting the desired body, cover and cap.

Referring now to FIGS. 18 through 24, the buckle according to the embodiment shown in these figures is very similar to that shown in the preceding figures and described above. The overall arrangement and function of the components is essentially the same. Specific parts corresponding in substance to those in the previously described embodiment are provided with the additional digit "1" in front of the same reference numeral as was used in the preceding embodiment. However, in this particular embodiment, there are scallops shown on the side of the latch plate 133 and which can best be seen in FIGS. 18 through 21. The scallops are also continued up the outboard edge of latch plate arm 138. These scallops have typical radii of 0.025 inches and a total depth of 0.025 inches. The high points thereof contact the interior face of the frame sidewall 117 which provides a guide surface for the latch plate as it is pushed down upon insertion of the buckle, and returned to latching position by the return spring 139 which is exactly the same as shown in the preceding embodiment. Also, the release slide 113 has horizontally-spaced vertical ribs along each of its sides. These ribs are horizontally spaced (about 0.150 inches on center) and the high points thereof (about 0.025 inches high) contact the guide surfaces of the inside faces of the upstanding sidewalls 117 of the frame. The ribs are semi-cylindrical in cross sectional shape with a radius of 0.025 inches. The scallops and ribs provide relief between points of bearing of the guide surfaces and the slide and the latch member edge and contribute to freedom of movement in dirty environments.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A buckle comprising:

a body having an entrance to admit a latchable tongue;

a latch member in said body and having a latching pawl thereon;

said latch member being pivotable in said body to enable said latching pawl to move into a latching position to interfere with movement of a tongue through said entrance;

resilient means urging said pawl to said latching position;

guide means in said body defining a guideway for a release slide; and a release slide received in said guideway and having a rest position and a release position, and normally biased to said rest position;

said release slide having ribbed surface means guidingly engaged by and slidable on a portion of said guide means for sliding movement from said rest position to said release position; and said latch member having a portion engageable by a portion of said slide when said slide is moved from said rest position to said release position to move said latching pawl out of said latching position.

2. A buckle comprising:

a body having an entrance to admit a latchable tongue;

a latch member in said body and having a latching pawl thereon;

said latch member being pivotable in said body to enable said latching pawl to move into a latching position to interfere with movement of a tongue through said entrance;

resilient means urging said pawl to said latching position;

guide means in said body defining a guideway for a release slide; and a release slide received in said guideway and having a rest position and a release position, and normally biased to said rest position;

said latch member having a portion engageable by a portion of said slide when said slide is moved along said guideway from s id rest position to said release position to move said latching pawl out of said latching position;

said release slide including side walls in said guide means and having bearing surfaces engaging said guide means, said side walls including relief features associated with said bearing surfaces to prevent foreign material between said slide and said guide means from interfering with free movement of said release slide along said guideway from said rest position to said release position.

3. The buckle of claim 2 and wherein:

said relief features include a plurality of ribs in said side walls and extending in a direction transverse to the direction of said movement of said slide.

4. The buckle of claim 3 and wherein:

said ribs have a height of about 0.025 inches and a rib-to-rib spacing of about 0.150 inches.

5. The buckle of claim 3 and wherein:

said ribs are parallel to each other and extend in a direction perpendicular to said direction of movement, and said ribs are arranged in a series extending in a direction parallel t said direction of movement.

6. A buckle comprising:

a body having an entrance to admit a latchable tongue;

a latch member in said body and having a latching pawl thereon;

said latch member being pivotable in said body about an axis to enable said latching pawl to move into a latching position to interfere with movement of a tongue through said entrance;

resilient means urging said pawl to said latching position;

a guide wall in said body having a guide surface in a plane perpendicular to said axis; and a release member in said body and having a rest position and a release position, and normally biased to said rest position;

said latch member having a portion engageable by a portion of said release member when said release member is moved from said rest position to said release position to move said latching pawl out of said latching position;

said latch member including an edge with a series of spaced high points at said guide surface to slide on said guide surface during pivoting of said latch member.

7. The buckle of claim 6 wherein:

said edge is scalloped to provide said series of high points.

8. The buckle of claim 7 wherein:

said latch member includes an upwardly extending arm, the latch member and arm having said edge thereon, and the scalloped edge is generally L-shaped.

9. The buckle of claim 6 and wherein:

said buckle includes a structural frame inside said body, said frame having parallel side walls, said guide surface being an inside face of one of said walls, and said latch member edge having relief features therein to inhibit interference of dirt with the operation of said latch member.

10. The buckle of claim 9 and wherein:

said edge of said latch member is L-shaped and guidingly engageable with said guide surface of said one of said frame side walls, and said relief features include series of ribs spaced along said edge.

11. A buckle comprising:

a plastic housing having an entrance to admit a latchable tongue, and having first guide means therein to guide the tongue along a first path in the housing;

a latch member in said housing to latch the tongue therein:

a plastic release member slidable in said housing along a second path parallel to said first path and operable on said latch member to unlatch the tongue;

second guide means in said housing for guiding said release member; and a plastic cap fixed to said release member;

with resilient latch means attaching the cap to the release member;

said housing and cap being made of the same material composition and color, and said release member being made of a different material composition and color.

12. The buckle of claim 11 wherein:

one of said release member and said latch means has resilient tabs at sides thereof, and the other of said release member and said latch means has cavities in sides thereof, said tabs having shoulders latched in said cavities.

13. The buckle of claim 11 wherein:

said first guide means include two co-planar flanges; and said cap has a front face which is curved about an axis perpendicular to the plane of said flanges.

14. The buckle of claim 11 wherein:

said release member has a front face and a lower front surface below said face and which is inclined inward from the face to the entrance.

15. The buckle of claim 11 wherein:

said cap is on the top of said release member.

16. The buckle of claim 15 wherein:

said release member has an end exposed adjacent said housing entrance whereby said member can be pushed by the buckle user to slide along said second path to unlatch the tongue;

said housing and cap are substantially the same color; and said release member is a contrasting color to establish clear visual distinction of said exposed end from said housing and thereby facilitate user recognition of said end to be pushed.

17. The buckle of claim 15 wherein:

said release member has upwardly opening cavities therein;

said resilient latch means include legs extending downward into said cavities and hooked onto said release member.

18. The buckle of claim 17 wherein:

said resilient latch means include said cap resiliently stressed to fittingly conform to said top of said release member to hook said legs to ledges in said release member.

19. The buckle of claim 15 wherein:

said release member has an upwardly extending front flange and a front outer face which extends upward onto said flange; and said cap extends rearward from said front flange and hides all of the top of said release member external to said housing except said front flange.

* * * * *